United States Patent [19]

Tanaka

[11] Patent Number: 4,572,686

[45] Date of Patent: Feb. 25, 1986

[54] APPARATUS FOR MAKING LABELS

[75] Inventor: Kenmei Tanaka, Hyogo, Japan

[73] Assignee: Kanzaki Paper Mfg. Co., Ltd., Tokyo, Japan

[21] Appl. No.: 667,161

[22] Filed: Nov. 1, 1984

[30] Foreign Application Priority Data

Nov. 21, 1983 [JP] Japan ..... 58-220396

[51] Int. Cl.[4] ..... B41F 13/58

[52] U.S. Cl. ..... 400/621.1; 400/508; 400/613.2; 101/226; 101/27; 83/371

[58] Field of Search ..... 101/27, 226, 227; 400/508, 509, 621.1, 621, 613.2, 613.3, 614; 83/371, 408, 423, 302, 404, 673; 242/75.5, 62

[56] References Cited

U.S. PATENT DOCUMENTS

| | | | |
|---|---|---|---|
| 1,628,870 | 5/1927 | Alfred | 83/673 X |
| 1,857,037 | 5/1932 | Bacon | 242/62 |
| 2,476,326 | 7/1949 | Sherman | 83/302 X |
| 2,513,085 | 6/1950 | Fairbanks | 242/75.5 |
| 3,113,742 | 12/1963 | Bevan et al. | 400/614 X |
| 3,401,585 | 9/1968 | Schmermund | 83/673 X |
| 3,407,690 | 10/1968 | Stanley | 83/371 X |
| 3,697,300 | 10/1972 | Von Hofe | 101/227 X |
| 3,774,489 | 11/1973 | Kercher et al. | 83/423 |
| 4,282,808 | 8/1981 | Clay | 101/227 X |
| 4,313,376 | 2/1982 | Swope et al. | 101/27 |

*Primary Examiner*—Clifford D. Crowder

*Attorney, Agent, or Firm*—Finnegan, Henderson, Farabow, Garrett & Dunner

[57] ABSTRACT

An apparatus for forming labels from paper that has a label forming layer and a transfer carbon layer. The label layer has marks thereon having a known relationship to the intended edges of the label. A photoelectric detector activates a label cutting mechanism in response to the marks. The apparatus further includes a winding means for collecting the transfer carbon paper as well as paper trimming subsystems for facilitating the separation of the label layer from the transfer carbon layer.

20 Claims, 5 Drawing Figures

APPARATUS FOR MAKING LABELS

BACKGROUND OF THE INVENTION

1. Field of the Invention

The present invention relates to an apparatus for the making of labels.

2. Description of the Prior Art

Labels have come to be widely used for the identification of articles and goods in connection with their transportation, distribution and sale. Conventional label printers usually form the printed label pattern by heat transfer printing from information that is input through a keyboard, as for example, the name, destination, specification and quantity of various commodities. The information is normally placed on a plurality of individual labels adhered by pressure sensitive adhesive to a continuous web of paper. Alternatively, a plurality of label patterns are printed on a continuous web of ordinary printing paper, which is then cut into a plurality of individual labels. The labels are ordinarily manually cut and this involves the visual judgment on the part of an equipment operator.

The first conventional method mentioned above has the disadvantage that it requires costly paper material and it is difficult to change the size and shape of the individual labels. The second conventional method of forming labels mentioned above has the disadvantage of requiring labor in connection with the cutting of the labels at the appropriate position on the printed paper. While the cutting operation can be facilitated by having perforations in a continuous paper sheet, this requires a preliminary step of perforating the paper and an additional apparatus to carry out such a step. Forming such perforated paper is certainly feasible but not suitable for those who are not primarily engaged in paper making or the production of labels and deal with the labels primarily as users.

It is the principal object of this invention to provide an automatic label making apparatus having a cutting mechanism associated therewith that will automatically produce labels of a predetermined size from a relatively inexpensive continuous web of paper. It is an additional object of the present invention to provide a ready means for disposing of transfer carbon paper used in the forming of the labels. These and further objects of the invention will be apparent from the following description or may be learned by practice of the invention.

SUMMARY OF THE INVENTION

The present invention is an apparatus for making labels that includes a means for printing label information on a continuous web of paper. The paper comprises a layer of label paper and a layer of transfer carbon paper and includes, on the label side, marks having a known relationship to the intended edges of the label. Slitting means are adjacent the printing means and are disposed to continuously trim the opposite longitudinal edges of the web. Means are provided for driving the web through the apparatus and for winding the carbon paper in the form of a cylindrical roll after it has been separated from the label paper. The winding means includes a clutch for compensating for the changing diameter of the roll. The apparatus further includes means for photoelectrically detecting the marks on the label side and/or opposite side thereof of the paper and cutting means, operating in conjunction with the detecting means, for cutting the label paper into individual labels. Preferably, the printing means is a heat transfer printer. It is further preferred that the apparatus include an electric motor for driving the winding means with a friction clutch between the electric motor and the winding means. Most preferably, the cutting means comprises a rotating member having a spiral blade affixed thereto. A stationary blade is disposed to be engaged by the spiral blade with both the rotating member and the stationary blade being disposed across the width of the label layer.

An embodiment of the present invention is depicted in the following figures which constitute a part of this specification.

DESCRIPTION OF THE PREFERRED EMBODIMENTS

The present invention is an apparatus for making labels including means for forming the labels from large sheets of paper having the information of the label printed thereon. Preferably, the printing is done by means of heat transfer printing wherein heat provides a printing pattern to effect the printing on a continuous web of printing paper. Such a unit is shown schematically as printing unit 10 in FIG. 1.

Figure 2:
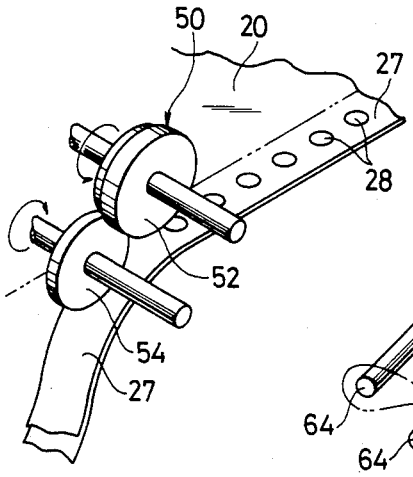
FIG. 2 is an enlarged perspective view of the slitting mechanism depicted in FIG. 1.

Conventional paper formed of a layer of what will be termed label paper and transfer carbon paper is particularly useful with the present invention. Paper being folded in the form of the letter Z with sprocket apertures provided along its longitudinal edges for feeding the paper through the printing means is also preferred. Paper of such a configuration is shown as paper 20 in FIG. 2. It is further preferred that the adhesion of the label paper 25 and the transfer carbon paper 26 be confined to the longitudinal edges for reasons that will be disclosed hereinafter.

Figure 1:
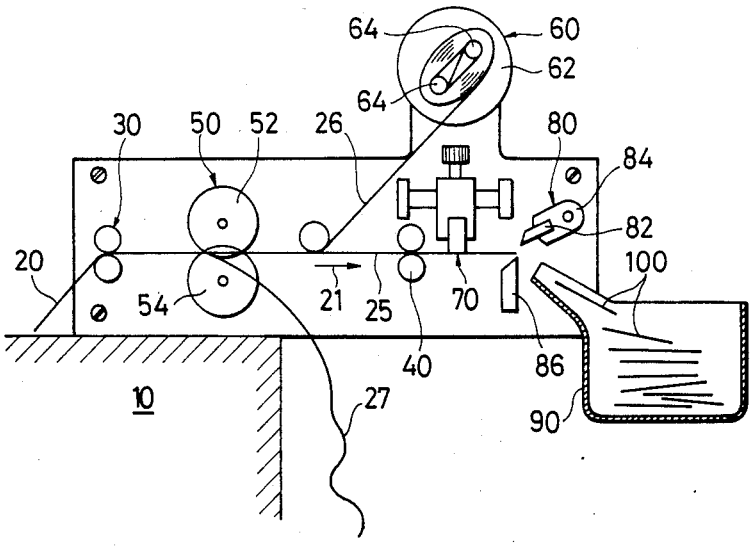
FIG. 1 is a schematic side elevational view of one embodiment of the present invention.

As depicted schematically in FIG. 1, the paper 20 is taken from the printing unit 10 and thereafter formed into labels by additional subsystems of the apparatus. After the images are printed on the paper by the printing unit 10, the printed paper 20 leaves the printing unit urged by an opposed pair of feed rolls 30 disposed to propel the paper in the direction of the arrow 21 depicted in FIG. 1. As here embodied, the first pair of feed rolls 30 engage the opposite surfaces of the paper 20 and remove it from the printing unit 10.

In accordance with the invention, the labels include a mark having a known relationship to the intended edges of the label. The mark may be pre-printed on the paper before it is placed in the printing unit or this mark may be printed on the paper in the printing unit. In any event, the paper should include a detectable mark that will be used by the apparatus to cut the paper into labels of an appropriate size.

In accordance with the invention, the apparatus includes slitting means adjacent the printing means. The slitting means are disposed to continuously trim the opposite longitudinal edges of the web. As here embodied and most clearly depicted in FIG. 2, a slitter 50 is provided for cutting away the longitudinal edges of the continuous paper 20. The slitter 50 is comprised of a pair of transversely spaced rotating slitting members 52 and 54. In the embodiment depicted, the paper has, along each longitudinal edge 27, a plurality of perforations 28 and the label paper 25 is adhered to the transfer carbon paper 26 along the longitudinal edges 27 of the web 20. In a preferred embodiment of the present invention, the slitting means cuts the web 20 inwardly of the adhered areas, thus freeing the transfer layer from the paper layer.

Figure 3:
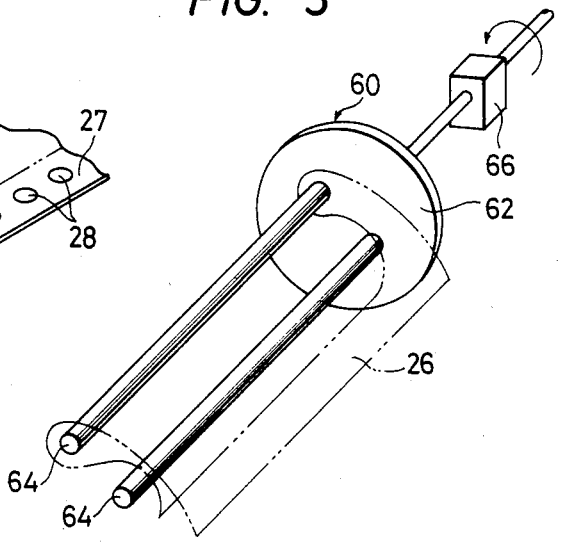
FIG. 3 is a perspective view of the winding apparatus depicted in FIG. 1.

In accordance with the invention, means are provided for winding the transfer paper separated from the label paper in the form of a cylindrical roll. The winding means includes a clutch for compensating for the changing diameter of the roll. As here embodied and most clearly depicted in FIGS. 1 and 3, the apparatus includes the spool 60 which is comprised of an opposed pair of circular members 62 and two longitudinally extending layer engaging rods 64 that are radially spaced from the axis of rotation of the spool. As is depicted schematically in FIG. 3, it is preferred that the winding means include a clutch 66 between the electric motor driving the spool 60 of the winding mechanism. As depicted in FIG. 1, when the winding mechanism receives the transfer paper, the diameter of the material on the spool will change. Therefore, if the spool 60 is driven at a constant rotational rate, the linear rate of takeup of the transfer paper 26 would change and the tension on the transfer paper would be excessive. The friction clutch 66 is designed to provide a constant rate of takeup of the transfer layer that is the same as the rate of the movement of the web 20 and label layer 25 through the apparatus.

In accordance with the invention, the apparatus includes a means for photoelectrically detecting marks on at least one of the label side and back side of the paper. As shown schematically in FIG. 1, a detector 70 is provided for detecting timing marks that are on the label layer 25 of the paper 20. The timing marks may be printed by the printing unit 10 or may be already present on the paper supplied to the printing unit or may be part of the label information on the label itself. As depicted schematically in FIG. 1, the position of the detector 70 may be adjusted laterally along the direction of movement of the paper through the apparatus. This allows the detector 70 to be in alignment with a mark at the time the cutter would be activated to cut the label at the appropriate location. While this embodiment is preferred, it is also possible that the detector 70 can be stationary and work in conjunction with a timer (not shown) which would enable the cutter to be activated after a pre-set period of time from the detection of a particular timing mark by the detector 70. This embodiment would also cut the label layer 25 at the appropriate time and therefore at the appropriate location.

Figure 4:
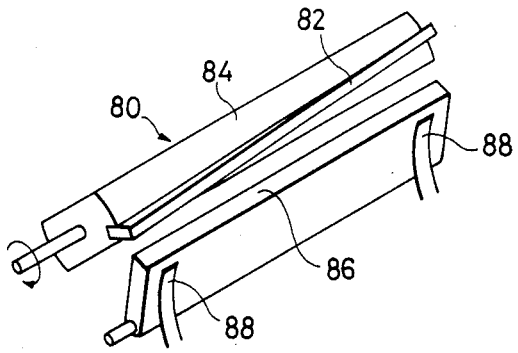
FIG. 4 is a perspective view of the cutting means depicted in FIG. 1.

In accordance with the invention, the apparatus further includes cutting means operating in conjunction with the detecting means for cutting the label paper into individual labels. As here embodied and depicted in FIGS. 1 and 4, the cutter 80 comprises a spiral blade 82 secured to the surface of a rotating member 84. A stationary blade 86, shown here urged by a pair of leaf springs 88 is biased into contact with the rotary blade 82 as depicted in FIG. 4.

When continuous Z-folded paper is used, the fold lines of the Z form define one of the cutting positions for the label. The ease of cutting such Z-form paper depends on the position of the fold and if it is above the paper, it is likely that the paper may be caught between the cutter blades without being cut. This problem may be solved by adjusting the strength of the leaf springs 88 urging the stationary blade 86 against the rotary blade 82.

Figure 5:
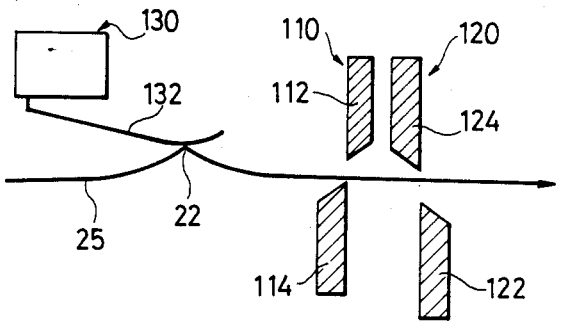
FIG. 5 is a schematic cross-sectional side view of a separate cutting means useful with the present invention.

Another solution is depicted in FIG. 5. In this embodiment, there are two cutters, 110 and 120. The first cutter 110 first encountered by the paper 25 as it arrives at the cutting means. The cutter 110 is comprised of a moveable blade 112 disposed above the paper path and further disposed to engage the stationary blade 114 which is located immediately below it. The second cutter 120 is comprised of a moveable blade 122 below the paper path and a stationary blade 124 disposed above the paper path. In normal operation, only the first cutter 110 is activated and the second cutter 120 does not function. The second cutter 120 is activated only when the paper has an upwardly directed fold thereon. When the fold has arrived at the cutter 120 upon the expiration of a certain period of time that is set on a timer (not shown) after the operation of the cutter, in the event the first cutter 110 has already cut the label off completely, the label 100 falls into the receptacle 90 and the second cutter 120 is activated unnecessarily. If, however, the first cutter 110 does not completely cut off the label, the second cutter 120 cuts it off.

As schematically depicted in FIG. 5, a microswitch 130 is provided above the paper path before the cutters 110 and 120. The microswitch 130 detects if the paper 25 has an upwardly or downwardly directed fold, by means of an actuator 132 which is pushed up by an upwardly directed fold 22. If the microswitch 130 detects an upwardly directed fold, a keep relay (not shown) is actuated to hold circuit continuity through a driving system for the cutter 120 and the cutter 120 is activated at the expiration of the time set on the timer simultaneously with the operation of the cutter 110. The keep relay is reset by a switch (not shown) operated when the cutter 120 has been activated. Although both of the cutters 110 and 120 are designed for operation when the paper is difficult to cut only by the cutter 110, it is also alternatively possible to keep the cutter 110 inactivated and activate only the cutter 120 upon the expiration of a certain period of time after the movement of the paper past the cutter 110. It should also be noted that the moveable blades of the two cutters, 110 and 120, do not necessarily need to be moved in opposite directions.

The present invention provides a commercially feasible manner of forming labels of different sizes from continuous webs of paper having label patterns printed thereon. In the embodiment using transfer carbon paper, the carbon paper is separated from the label paper and is readily disposed of. The individual labels may be cut automatically and accurately because the cutter is operated in accordance with marks on the paper that are located to facilitate the cutting of the individual labels at the appropriate location. This allows the automated production of individual labels of different dimensions without the need for costly labor. It further enables the efficient production of labels in a continuous process in which both printing and cutting are carried out in a single piece of equipment. Furthermore, the apparatus of this invention may be simply added to an ordinary printer. It is therefore suitable for the economical preparation of labels by those who are engaged in transportation, distribution or sales.

The present invention has been disclosed in terms of preferred embodiments. The invention is not limited to the depicted embodiments but is determined by the scope of the appended claims and their equivalents.

What is claimed is:

1. An apparatus for making labels, said apparatus comprising:

means for printing label information on a continuous web of paper wherein said paper comprises a layer of label paper and a layer of transfer carbon paper, said paper including, on at least one of the label side and back side of said label paper, marks having a known relationship to the intended transverse edges of said labels;

slitting means adjacent said printing means, said slitting means being disposed to continuously trim the opposite longitudinal edges of said web;

means for driving said web through said apparatus;

means for winding said carbon paper separate from said label paper in the form of a cylindrical roll, said winding means including clutch means for compensating for the changing diameter of said roll;

means for photoelectrically detecting said marks on the label paper; and cutting means operating in conjunction with said detecting means, said cutting means cutting said label paper into invidividual labels.

2. The apparatus of claim 1 wherein said printing means comprises a heat transfer printer.

3. The apparatus of claim 1 wherein said drive means comprise a first opposed pair of drive rolls adjacent said printing means driving opposite sides of said web, and a second opposed pair of drive rolls driving opposite surfaces of said layer of label paper.

4. The apparatus of claim 1 wherein said apparatus includes an electric motor for driving said winding means and a friction clutch between said motor and said winding means.

5. The apparatus of claim 1 wherein said detecting means is adjustable along the direction of travel of said label layer through said apparatus.

6. The apparatus of claim 1 wherein said cutting means comprises a rotary member having a spiral blade affixed thereto and a stationary straight blade disposed to be engaged by said spiral blade, said spiral blade and said stationary blade extending across the width of said label layer.

7. The apparatus of claim 1 wherein said slitting means comprises two pairs of opposed rolls to cut said paper between spaced rotating members.

8. The apparatus of claim 1 wherein said layers are adhered to one another only in the portion of said web removed by said slitting means.

9. The apparatus as in claim 1 wherein said apparatus includes means for detecting transverse folds in said label layer, said cutting means being responsive to said fold detecting means, and said cutting means having at least two cutting units for sequentially engaging substantially the same location in response to a detected fold on the web.

10. The apparatus of claim 9 wherein said cutting means comprise first and second pairs of cutter blades, each pair having a movable cutting blade opposed by a respective stationary cutting blade, the actuation of the first pair of cutting blades being timed in relation to a detected fold in said paper layer to provide engagement of said label layer by said first pair at a particular location thereon, said second pair being positioned downstream of said first pair with respect to the direction of travel of said label layer, the actuation of said second pair being timed to subsequently engage said label layer at said location on said label layer, and thereby to insure severing of the web at said location.

11. An apparatus for making labels from continuous Z-folded paper having a carbon transfer layer and a label layer, said label layer having marks thereon having a known relationship to the intended edges of said label, said layers being adhered only along the opposite longitudinal edges, said apparatus comprising:

printing means for printing label information on the side of said label layer bearing said marks;

a first pair of drive rolls adjacent said printing means, said first drive rolls engaging opposite surfaces of said paper;

two pairs of opposite slitting members adjacent said first drive rolls, said pair of slitting members being disposed to trim off the adhered longitudinal edges of said paper;

means for winding said carbon transfer layer including an electric motor and clutch means for winding said carbon transfer layer at a rate equal to movement of said paper through said apparatus;

a second pair of drive rolls engaging opposite surfaces of said label layer;

a photoelectric detector adjacent said second pair of drive rolls, said detector being disposed to detect said marks; and a cutter for forming said label layer into labels, said cutter being controlled in response to the location of said marks on said paper layer as determined by said detector.

12. The apparatus of claim 11 wherein said winding means for said transfer layer winds said transfer layer around a cylindrical spool having two longitudinally extending layer engaging rods, said rods being radially spaced from the axis of rotation of said spool.

13. The apparatus of claim 11 wherein said cutter is a rotary cutter having a rotationally driven cutting member disposed across the width of said label layer, said rotationally driven cutting member engaging a stationary cutting member also disposed across the width of said label layer, said rotationally driven member being driven in response to the detection of said marks by said photoelectric detector.

14. The apparatus as in claim 11 wherein said apparatus includes means for detecting transverse folds in said label layer, said cutting means being responsive to said fold detecting means, and said cutting means having at least two cutting units for sequentially engaging substantially the same location in response to a detected fold on the web.

15. The apparatus of claim 14 wherein said cutting means comprise first and second pairs of cutter blades, each pair having a movable cutting blade opposed by a respective stationary cutting blade, the actuation of the first pair of cutting blades being timed in relation to a detected fold in said paper layer to provide engagement of said label layer by said first pair at a particular location thereon, said second pair being positioned downstream of said first pair with respect to the direction of travel of said label layer, the actuation of said second pair being timed to subsequently engage said label layer at said location on said label layer, and thereby to insure severing of the web at said location.

16. The apparatus as in claim 14 wherein said two cutting units are spaced along the direction of movement of the web, and each of said cutting units includes an upper cutting blade and a lower cutting blade offset from the upper blade of said respective pair in the web movement direction, and wherein the offset direction in one of said pairs is opposite the offset direction in the other of said pairs.

17. The apparatus as in claim 14, wherein means for actuating said first and second pairs of cutting blades includes means for keeping one of said first and second pairs of cutting blades deactivated upon activation of the other pair for cutting, when no fold is present at the cutting apparatus.

18. The apparatus as in claim 14 wherein one blade of each of said first and second pairs of cutting blades is movable and the other blade of each respective pair is stationary, wherein said movable blade in said first pair moves in a direction opposite the moving direction of said movable blade in said second pair.

19. The apparatus as in claim 14 wherein said activation means activates both said first and said second cutting means only upon arrival of a fold oriented in a particular direction relative to the plane of the web.

20. The apparatus as in claim 12 further comprising a pair of cutters each with a blade movable perpendicularly to the paper plane, wherein only a predetermined one of said cutters is actuated when a fold oriented in a particular direction is detected in said z-folded paper.

* * * * *